United States Patent [19]

Persson

[11] 4,049,188

[45] Sept. 20, 1977

[54] PACKAGE

[75] Inventor: Lennart Gerhard Persson, Bjarred, Sweden

[73] Assignee: AB Akerlund & Rausing, Lund, Sweden

[21] Appl. No.: 739,451

[22] Filed: Nov. 8, 1976

[30] Foreign Application Priority Data

Nov. 13, 1975 Sweden ..... 7512727

[51] Int. Cl.[2] ..... B65D 5/56; B65D 21/02

[52] U.S. Cl. ..... 229/14 BL; 206/519

[58] Field of Search ..... 206/519, 520; 229/14 BL, 14 BA

[56] References Cited

U.S. PATENT DOCUMENTS

| | | | |
|---|---|---|---|
| 3,372,830 | 3/1968 | Edwards | 206/520 X |
| 3,468,468 | 9/1969 | Foote | 229/14 BL |
| 3,489,331 | 1/1970 | Andersson | 229/31 R X |
| 3,529,743 | 9/1970 | Ehrbar et al. | 206/519 X |
| 3,575,338 | 4/1971 | Dilot | 229/14 BL |

*Primary Examiner*—Davis T. Moorhead

*Attorney, Agent, or Firm*—Lerner, David, Littenberg & Samuel

[57] ABSTRACT

An improved package is provided which is formed from a blank of rigid material, such as cardboard, and an internal lining of plastic material, with the rigid blank including a bottom wall and a plurality of side walls. The internal lining extends over the top edge of the side walls and along the exterior walls of the package to define an exterior lining. The free edge of the exterior lining includes a flange extending in a direction outwardly from the side walls of the package. In addition, extension flaps of one package are operable to act as a stop and engage a portion of another package nested therewith to prevent the nested packages from being wedged within each other.

5 Claims, 6 Drawing Figures

PACKAGE

FIELD OF THE INVENTION

The present invention relates generally to packages, and specifically to an improved package which includes structure to prevent such packages from becoming wedged within each other when they are stacked or nested.

BACKGROUND OF THE INVENTION

Packages, such as cups, are normally stacked in a nested arrangement so as to conserve space during storage, transport, or handling. However, there has been a problem that such nested packages become wedged within each other, so that it is difficult to remove individual packages from the stack. This problem is even more serious in the case where such packages or cups include plastic or foil linings, since such linings allow the packages or cups to become more tightly wedged within each other when nested. It would therefore be highly desirable to provide a package with simple and inexpensive means for preventing such packages from becoming wedged within each other when stacked in a nested arrangement.

Broadly, it is an object of the present invention to provide an improved package which overcomes the aforesaid problems. Specifically, it is within the contemplation of the present invention to provide an improved package which is provided with a simple and inexpensive manner of preventing such lined packages from becoming wedged within each other when nested.

SUMMARY OF THE INVENTION

Briefly, in accordance with the principles of the present invention, an improved package is provided which includes means to prevent lined packages from becoming wedged within each other during nesting. The package is formed from a blank of rigid material, such as cardboard or similar rigid material, and an internal lining of plastic material which is deep-drawn within the package. The rigid blank includes a bottom wall, a plurality of side walls, and preferably also joining walls connecting the side walls. The internal lining extends over the top edge of the side walls and joining walls of the package and also extends along the exterior walls of the package to define an exterior lining. The free edge of the exterior lining includes a flange extending in a direction outwardly from the side walls of the package. In addition, extension flaps of one package are operable to act as a stop and engage a portion of another package nested therewith to prevent the nested packages from being wedged within each other.

In the present invention, the plastic lining is preferably formed from an extremely thin material, for instance, a polyvinyl-chloride foil having a thickness in the range of 0.10–0.15 mm, as compared with conventional foil thicknesses in the range of 0.25–0.40 mm. In addition, other plastic foils would be suitable. For example, good results are obtained by using HD-PE-foils having a thickness in the range of 0.10–0.15 mm.

However, the use of extremely thin plastic foils may create difficulties with respect to separating nested packages when, for example, such nested packages are delivered to a filling and sealing machine. More particularly, in certain situations, the outwardly-directed flange may be too pliable to serve as a support for an entire stack of packages, when an underlying package is to be withdrawn from the stack so that it may be filled by the filling and sealing machine. Therefore, in a preferred embodiment, one or more of the side walls, and/or one or more of the joint walls, are provided with extension flaps which are folded out and down toward the exterior of the walls of the package, and the plastic lining is folded outwardly over the extension flaps, and preferably completely overlaps the extension flaps. In this manner, the strength of the pliable flange is reinforced by the extension flaps. Alternatively, the package may be provided with embossed portions on one or more of the walls of the package to facilitate the separation of individual packages from the nested stack.

BRIEF DESCRIPTION OF THE DRAWINGS

Further objects, features, and advantages of the present invention will become apparent upon the consideration of the following detailed description of a presently-preferred embodiment when taken in conjunction with the accompanying drawing wherein.

DETAILED DISCUSSION OF PREFERRED EMBODIMENTS OF THE INVENTION

Figure 1:
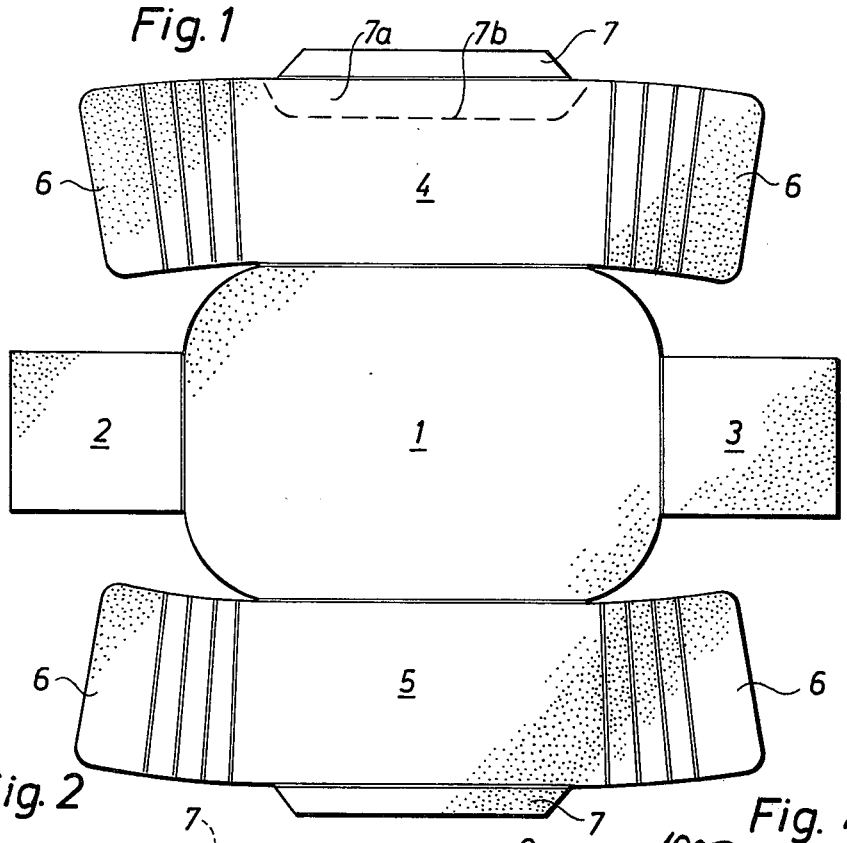
FIG. 1 illustrates an unfolded blank intended to form the body of the package in accordance with the present invention.

There is shown in FIG. 1 a blank of rigid material, such as cardboard, which includes a bottom wall 1, four side walls 2, 3, 4, and 5, and joint or corner walls 6. In addition, if desired, the side walls 4 and 5 may each be provided with extension flaps 7, the purpose of which will be more fully explained herein.

In manufacturing the package of the present invention, blank 1 is placed in a mold, the external dimensions of which substantially correspond to those of the final package. With the blank in the mold, a plastic lining foil is placed over the mold and is deep-drawn into the package to form a lining 10 which lines the internal walls of the package.

Figure 2:
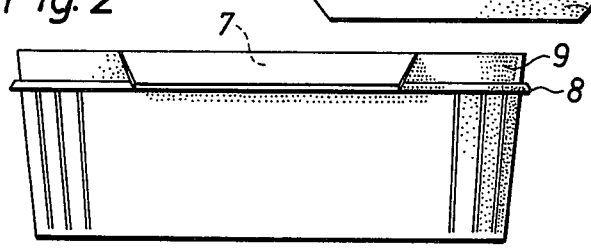
FIG. 2 is a side elevational view of the package.
Figure 5:
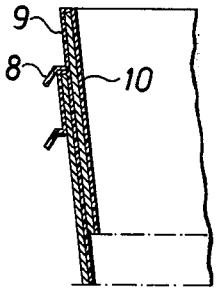
FIG. 5 is a cross-sectional view along the lines B—B of FIG. 3.

Simultaneously, as may be seen in FIGS. 2 and 5, during the deep-drawing process, the plastic foil is extended to overlap the top edge of the side walls of the package, and such portion of the lining is designated 10*a*. Simultaneously, during the deep-drawing process, portions of the lining are extended downwardly along the exterior of the side walls of the package so that the lining is closely joined to the exterior of the cardboard blank, which exterior lining is designated by the reference numeral 9. During the deep-drawing process, the free edge of the exterior lining 9 is formed into a flange 8, which is directed outwardly and away from the side walls of the package.

Preferably, the plastic lining is adhered to the rigid blank by a suitable binding agent.

The internal lining 10 may be an extremely thin plastic foil, such as a polyvinyl-chloride foil having a thickness in the range of 0.10–0.15 mm, or a HD-PE-foil (high density polyethylene foils), or a corresponding plastic material suitable for deep-drawing.

Figure 4:
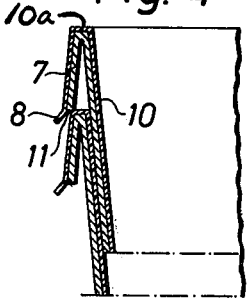
FIG. 4 is a cross-sectional view along the lines A—A of FIG. 3.
Figure 3:
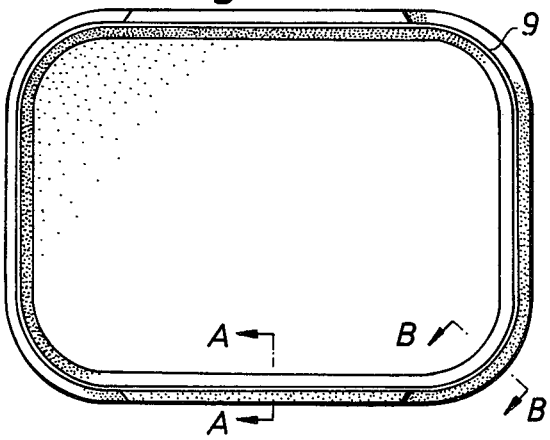
FIG. 3 is a top plan view of the package.

As explained above, as a result of the use of extremely thin plastic foils, difficulties may arise with respect to separating individual packages from their nested arrangement. Accordingly, in order to facilitate the separation of such nested packages, extension flaps 7 have been provided. During the forming of the package, flaps 7 are folded outwardly and downwardly toward the exterior of the side walls of the package. During the deep-drawing process, the internal lining 10 is extended outwardly over the extension flaps 7, as shown most clearly in FIG. 4. As a result, the lining 10 will completely overlap the extension flaps 7 and have a free edge which is formed into flange 8. With the flange 8 being reinforced in this manner, it is easier to insert a stack of such nested packages into the gripping means of a filling and sealing machine, so that the gripping means engages flange 8, with the free edge 11 of the extension flaps 7 being capable of supporting an entire stack of packages while the bottommost package is withdrawn for processing. In such an embodiment, the package will be stable even if the connection between the side walls and the extension flaps 7 is very pronounced or even replaced by a slitting or scribing operation. More particularly, because of the external portion of the lining 10 covering the extension flaps 7, the extension flaps cannot yield outwardly. In addition, inward yielding is prevented, since the cardboard blank material normally has sufficient elasticity to prevent such an inward yielding.

Figure 6:
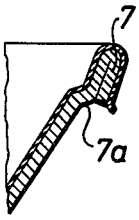
FIG. 6 is a cross-sectional view corresponding to FIG. 4 illustrating an alternative embodiment of the present invention.

As an additional modification, the external blank 1 may be provided with embossed portions on one or more of the side walls 2, 3, 4, and 5 and/or the joint walls 6. Such an embossed portion *7a* is illustrated on side wall 4 in FIG. 1. A cross-section of this embodiment is illustrated in FIG. 6. The inward folding of embossed portion *7a* is limited by a grooving, perforation, slitting, or the like *7b*.

In view of the foregoing, it should be clear that an improved package has been provided which simply and inexpensively prevents nested packages having linings from becoming wedged within each other. In addition, a cardboard material is normally used for the external blank. Owing to the fact that it further is possible to use an extremely thin plastic foil, the package is easily destroyed after use. Moreover, the risk of migration of unsuitable substances from the plastic material into the product in the package is reduced.

A latitude of modification, change, and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A package formed from a blank of rigid material, said blank including a bottom wall and a plurality of side walls and extension members extending outwardly from portions of said side walls, a lining of plastic material lining the internal walls of said package, said internal lining extending over the top edge of said side walls, said lining further extending along a portion of the exterior of the side walls of said package and along said extension members to define an exterior lining, said exterior lining further including a free edge defining a flange extending in a direction outwardly from the side walls of the package, said extension members reinforcing said flange and being operable to act as a stop for one part of the package and said flange being operable to act as a stop for another part of the package and engage a portion of another package nested therewith to prevent said nested packages from being wedged within each other.

2. A package according to claim 1 wherein said extension members include extension flaps folded outwardly and downwardly toward the exterior of the side walls of said package, said exterior lining extending along said extension flaps and including said free edge defining said flange, the strength of said flange being reinforced by said extension flaps.

3. A package according to claim 1 wherein said plastic lining is adhered to said rigid blank by binding agent.

4. A package according to claim 1 wherein one or more of said side walls include embossed portions operable as said extension members to facilitate the separation of nested packages.

5. A package according to claim 1 wherein said plastic lining is a polyvinyl-chloride foil of a thickness in the range of 0.10–0.15 mm.

* * * * *